US005557380A

United States Patent [19]

Maeda et al.

[11] Patent Number: 5,557,380

[45] Date of Patent: Sep. 17, 1996

[54] APPARATUS FOR DEVELOPING AN ELECTROSTATIC LATENT IMAGE HAVING LIMITING BLADE HOLDING DEVICE

[75] Inventors: Masahiko Maeda; Shoji Tomita; Masao Uyama; Masayuki Nakashima; Kenichiro Kitajima, all of Osaka, Japan

[73] Assignee: Mita Industrial Co., Ltd., Osaka, Japan

[21] Appl. No.: 492,511

[22] Filed: Jun. 20, 1995

[30] Foreign Application Priority Data

Jul. 7, 1994 [JP] Japan ..... 6-155610

[51] Int. Cl.[6] ..... G03G 15/06

[52] U.S. Cl. ..... 355/259; 118/661

[58] Field of Search ..... 355/259, 261, 355/245, 251, 253; 118/651, 661, 653, 656, 657, 658

[56] References Cited

U.S. PATENT DOCUMENTS

| | | | |
|---|---|---|---|
| 4,760,422 | 7/1988 | Seimiya et al. | 355/259 |
| 4,835,565 | 5/1989 | Nagatsuna et al. | 355/259 |
| 5,097,294 | 3/1992 | Nishio et al. | 118/651 X |
| 5,214,239 | 5/1993 | Koga et al. | 118/653 |
| 5,232,500 | 8/1993 | Kamaji et al. | 118/261 |
| 5,314,774 | 5/1994 | Camis | 355/259 X |
| 5,412,458 | 5/1995 | Kamaji et al. | 355/259 |

FOREIGN PATENT DOCUMENTS 0401020 12/1990 European Pat. Off. .

0547238 6/1993 European Pat. Off. .

OTHER PUBLICATIONS

Patent Abstracts of Japan, vol. 14, No. 158 (P-1027), to Matsushita Electric Ind. Co., Ltd., dated Mar. 27, 1990 02-015287.

*Primary Examiner*—Robert Beatty

*Attorney, Agent, or Firm*—Beveridge, DeGrandi Weilacher & Young, L.L.P.

[57] ABSTRACT

An apparatus for developing an electrostatic latent image includes a developing agent application device which holds the developing agent on the surface thereof in the developing agent-holding zone, and conveys the thus held developing agent into a developing zone to apply it onto the electrostatic latent image. A limiting device is included for limiting the amount of the developing agent held on the surface of the developing agent application device in a developing agent limiting zone located between the developing agent holding zone and the developing zone. The limiting device includes a blade made of a rigid member that is brought into forced contact with the surface of the developing agent application device, a blade support device for supporting the blade in a manner such that a first surface thereof is forced into contact with the surface of the developing agent application device, and a resilient urging device which is disposed on a side of a second surface of the blade. The blade support device includes lower support members for supporting the lower end at the blade. The application device has an Asker C hardness between 67 to 85, the blade exerts a line pressure of 40 to 90 g/cm, and the developing agent thickness is limited in the range of 20 to 27 μm.

25 Claims, 3 Drawing Sheets

APPARATUS FOR DEVELOPING AN ELECTROSTATIC LATENT IMAGE HAVING LIMITING BLADE HOLDING DEVICE

FIELD OF THE INVENTION

The present invention relates to an apparatus for developing an electrostatic latent image into a toner image in an image-forming machine such as an electrostatic copying machine or a laser printer. More specifically, the invention is concerned with an apparatus for developing an electrostatic latent image, which is equipped with a developing agent application means which holds the developing agent on the surface thereof and carries it into a developing zone, and a limiting means which limits the amount of the developing agent held on the surface of the developing agent application means.

DESCRIPTION OF THE PRIOR ART

In order to develop an electrostatic latent image into a toner image in an image-forming machine, as is well known, there has widely been used an apparatus for developing an electrostatic latent image which is equipped with a developing agent application means constituted by a roller or an endless belt that is rotated in a predetermined direction. Being rotated in a predetermined direction, the developing agent application means moves through a developing agent-holding zone, a developing agent amount-limiting zone and a developing zone successively. In the developing agent-holding zone, the developing agent supplied in a suitable manner is held on the surface of the developing agent application means. In the developing agent amount-limiting zone, the limiting means acts on the developing agent that is held on the surface of the developing agent application means, so that the developing agent held on the surface of the developing agent application means is limited to a required amount. In the developing zone, the developing agent is applied onto the surface of an electrostatic latent image carrier, such as a rotary drum which has an electrostatic photosensitive material on the peripheral surface thereof, and the electrostatic latent image formed on the surface of the electrostatic latent image carrier is developed into a toner image. In order to accomplish favorable developing, it is important that the developing agent is held in an accurately required amount and sufficiently uniformly in the direction of width on the surface of the developing agent application means by properly limiting the amount of the developing agent held on the surface of the developing agent application means by using a limiting means.

Japanese Patent Publication No. 16736/1988 discloses an apparatus for developing an electrostatic latent image equipped with a limiting means of which the blade is constituted by an elastic rubber member that may be a synthetic rubber such as urethane rubber or silicone rubber. The elastic rubber member constituting the developing agent limiting means has one surface thereof or tip edge thereof that is brought into forced contact with the surface of the developing agent application means to limit the amount of the developing agent held on the surface of the developing agent application means to be a considerably small amount, whereby a thin layer of developing agent is formed on the surface of the developing agent application means. There has also been practically used a developing agent limiting means having a blade which is made of a thin stainless steel spring plate having a thickness of from 0.1 to 0.2 mm.

In the developing agent limiting means using an elastic blade made of an elastic rubber, a thin stainless steel plate, etc., it has been known that both end portions of the elastic blade have a low rigidity and hence, produce a limiting force smaller than that of the central portion. Therefore, the toner layer formed on the surface of the developing agent application means becomes thicker toward both ends compared with the central portion. According to experiment conducted by the present inventors, it was found that when an urethane blade was used, the toner layer at both end portions was thicker than the central portion by 3.5 to 7.0 μm. When the elastic blade is used, as described above, it is difficult to form the toner layer on the surface of the developing agent application means in a uniform thickness over the whole width direction thereof. As a consequence it becomes difficult to obtain a uniform image. Besides, the elastic blade has low abrasion resistance and is not necessarily satisfactory from the standpoint of life.

In order to solve the above-mentioned problems, the present applicant has filed Japanese Patent Application No. 96046/1994 covering an invention in which the blade constituting the developing agent limiting means is made of a rigid member such as a glass. By forming the blade of a sheet glass, it is allowed to limit the amount of the developing agent held on the surface of the developing agent application means uniformly in the direction of width and to improve abrasion resistance and to lengthen the life. However, it has been found that performance for limiting the amount of the developing agent is influenced by the accuracy of the support means for supporting the blade that is made of a sheet glass. Generally, the sheet glass can be supported by being adhered to a metallic support member. In this case, however, the surface precision of the adhering surface of the support member plays a considerably important role. When the adhering surface of the support member is distorted, the blade loses flatness since the sheet glass is stuck along the adhering surface of the support member. It is easy to accomplish the flatness of the sheet glass itself to be, for example, 0.01 or smaller. However, highly precisely machining the surface of the metallic support member requires an increased cost.

It was found through experiment conducted by the present inventors that when the developing agent limiting means is constituted by a rigid member such as glass, it is an important factor to choose the proper hardness of the drum or the roller that constitutes the developing agent application means. According to experiment, the thickness of the toner layer formed on the surface of the roller constituting the developing agent application means decreases with a decrease in the hardness of the roller and increases with an increase in the hardness of the roller. Moreover, the thickness of the toner layer formed on the surface of the roller constituting the developing agent application means changes depending upon the contacting force of the developing agent limiting means acting on the surface of the roller, and the thickness of the toner layer formed on the surface of the roller increases with the decrease in the contacting force and decreases with an increase in the contacting force. It was also found that a contacting force which is too small or contacting force or too large makes it difficult to stably obtain a uniform toner layer. It has been known that the quality of image greatly changes depending upon the thickness of the toner layer formed on the surface of the roller that constitutes the developing agent application means. When the thickness of the toner layer is smaller than, for example, 20 μm, the image density so decreases that a copy cannot be seen well. When the thickness of the toner layer exceeds, for example, 30 μm, on the other hand, there occurs a so-called image base fogging in which the toner adheres to portions other than the image. When the roller constituting the developing agent application means is made of a synthetic rubber, the production yield becomes poor when the synthetic rubber has an Asker's C hardness of not higher than 65, and it becomes difficult to stably maintain the quality. Therefore, the hardness of the roller must be set upon also considering the practical contacting force of the developing agent limiting means that acts upon the surface of the roller and maintenance of stable quality during the production of the roller.

SUMMARY OF THE INVENTION

The principal object of the present invention is to provide an apparatus for developing an electrostatic latent image equipped with a relatively cheaply constructed support means which is capable of maintaining surface precision of a blade made of a rigid member which constitutes a developing agent limiting means.

Another object of the present invention is to provide an apparatus for developing an electrostatic latent image in which a developing agent limiting means is constituted by a rigid member, and the hardness of the roller constituting the developing agent application means is limited to a predetermined value, thereby making it possible to obtain a desired image density and contributing to improving yields during the production and stably maintaining quality.

In order to accomplish the above-mentioned principal object, the present invention provides an apparatus for developing an electrostatic latent image comprising a developing housing, a developing agent application means which is disposed in the developing housing, holds the developing agent on the surface thereof in the developing agent-holding zone, and conveys the thus held developing agent into a developing zone to apply it onto the electrostatic latent image, and a limiting means for limiting the amount of the developing agent held on the surface of the developing agent application means in a developing agent limiting zone located between the developing agent holding zone and the developing zone, wherein the limiting means includes a blade made of a rigid member that is brought into forced contact with the surface of the developing agent application means, a blade support means for supporting the blade in a manner such that a first surface thereof is moved in a direction in which it comes into forced contact with the surface of the developing agent application means, and a resilient urging means which is disposed on a side of a second surface of the blade to push the blade in a manner such that the first surface thereof is brought into forced contact with the surface of the developing agent application means.

In order to accomplish the above-mentioned another object, the present invention provides an apparatus for developing electrostatic latent image comprising a developing housing, a developing agent application means which is disposed in the developing housing, holds the developing agent on the surface thereof in the developing agent-holding zone, and conveys the thus held developing agent into a developing zone to apply it onto the electrostatic latent image, and a limiting means for limiting the amount of the developing agent held on the surface of the developing agent application means in a developing agent limiting zone located between the developing agent holding zone and the developing zone, wherein the limiting means is made of a rigid member that is brought into forced contact with the surface of the developing agent application means, and the developing agent application means is constituted by a solid synthetic rubber roller having an Asker's C hardness of 67 to 85.

In the apparatus for developing electrostatic latent image of the present invention, the blade, made of a rigid member constituting the limiting means, is pushed by the resilient urging means, and its one surface is brought into forced contact with the surface of the developing agent application means, whereby the amount of the developing agent held on the surface of the developing agent application means is properly limited, and a desired developing agent layer is formed on the surface of the developing agent application means.

DETAILED DESCRIPTION OF THE PREFERRED EMBODIMENTS

A preferred embodiment of the apparatus for developing an electrostatic latent image constituted according to the present invention will be described in further detail with reference to the accompanying drawings.

Figure 1:
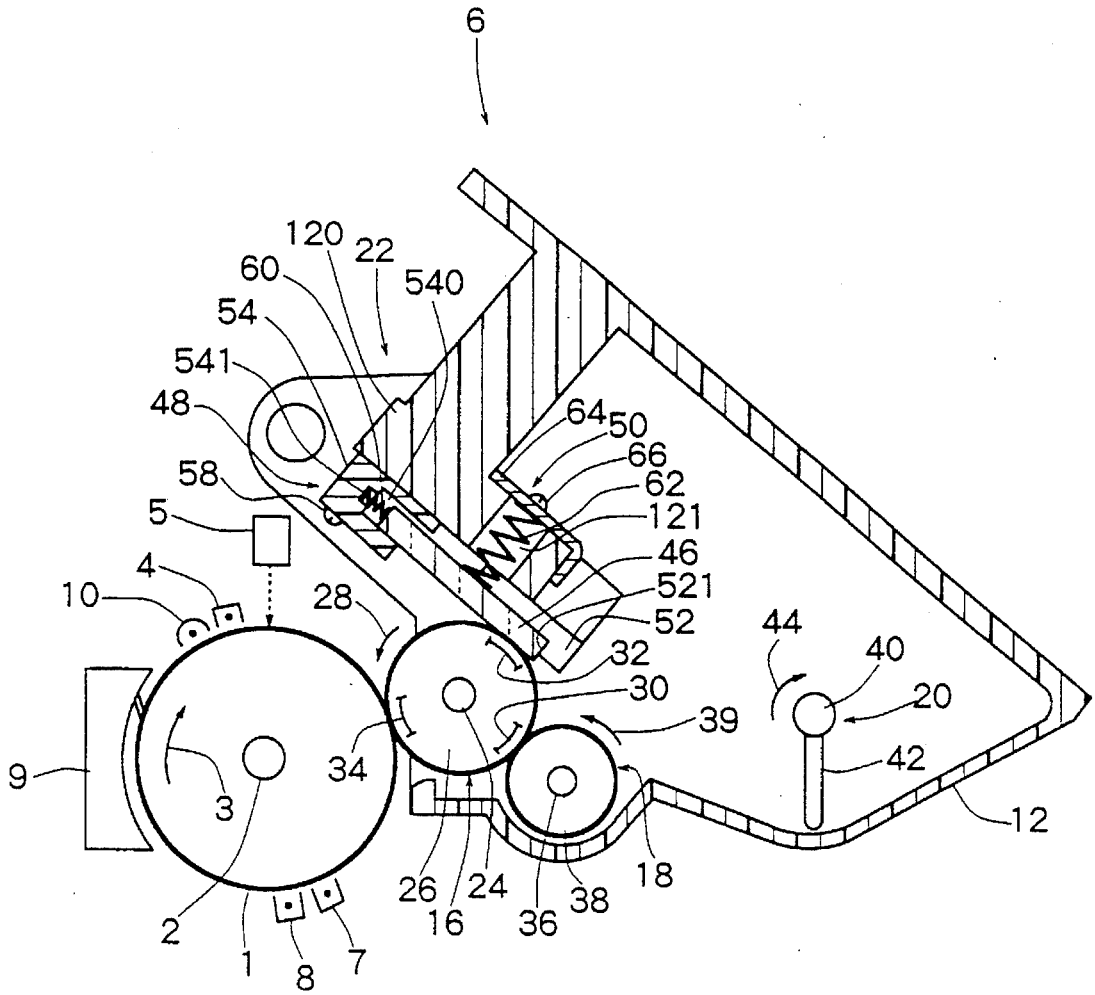
FIG. 1 is a sectional view which schematically illustrates the constitution of an image-forming machine including an apparatus for developing an electrostatic latent image constituted according to the present invention.

FIG. 1 illustrates an image-forming machine including an apparatus for developing an electrostatic latent image constituted according to the present invention. The illustrated image-forming machine is equipped with a rotary drum 1 which is provided with a photosensitive layer on the peripheral surface thereof and works as an image carrier. The rotary drum 1 is mounted in a housing by a rotary shaft 2 and is allowed to freely rotate. The rotary drum 1 which rotates in a direction indicated by arrow 3 is surrounded by a corona discharger 4 for electrically charging the photosensitive layer of the rotary drum 1 into a predetermined polarity, a laser optical unit 5 which is an exposing means for forming an electrostatic latent image on the photosensitive layer of the rotary drum 1 that has been electrically charged into a predetermined polarity by the corona discharger, an electrostatic latent image developing device 6 for developing an electrostatic latent image formed by a laser beam from the optical unit 5 into a toner image, a corona discharger 7 for transfer, a corona discharger 8 for peeling, a cleaning device 9 and a discharging lamp 10 that are arranged in the order mentioned as viewed in the direction in which the rotary drum 1 rotates.

The developing device 6 is equipped with a developing housing 12 which can be formed of a synthetic resin. In the developing housing 12 are arranged a developing agent application means 16, a feeding means 18, a stirrer means 20 and a limiting means 22. Though not illustrated, the developing housing 12 is fitted with a toner cartridge that contains toner.

The developing agent application means 16 includes a rotary shaft 24 which is rotatably mounted between the two side walls of the developing housing 12 and a roller 26 fitted to the rotary shaft 24. The rotary shaft 24 can be made of a suitable metallic material such as a stainless steel. The roller 26 is constituted by using a material which is relatively soft and has an electrically conductive property, such as an electrically conductive solid rubber, e.g., an urethane rubber. In the illustrated embodiment, it is desired that the roller 26 has an Asker's C hardness of about 67 to about 85 and a volume resistivity of about $10^6$ to about $109^9$ Ω.cm. The roller 26 of the developing agent application means 16 is exposed through an opening formed in the developing housing 12, and is opposed to the rotary drum 1. The peripheral surface of the roller 26 is brought into forced contact with the peripheral surface of the rotary drum 1; i.e., the peripheral surface of the roller 26 is resiliently compressed to some extent in the contacting region. The rotary shaft 24 of the developing agent application means 16 is continuously rotated by a driving means that is not shown in a direction indicated by arrow 28 in FIG. 1. Due to the rotation of the rotary shaft 24, the roller 26 is continuously rotated in a direction indicated by arrow 28, and the peripheral surface of the roller 26 successively passes through a developing agent holding zone 30, a developing agent limiting zone 32 and a developing zone 34.

The feeding means 18 includes a rotary shaft 36 which is rotatably mounted between the two side walls of the developing housing 12 and an auxiliary roller 38 fitted to the rotary shaft 36. It is desired that the auxiliary roller 38 is constituted by using a foamed material such as foamed silicone or foamed urethane. The auxiliary roller 38 is brought into contact with the roller 26 of the developing agent application means 16. It is desired that the hardness of the foamed material forming the auxiliary roller 38 is considerably smaller (e.g., Asker's C hardness of about 35) than the hardness of the roller 26. By bringing the auxiliary roller 38 into forced contact with the roller 26, it is desired that the auxiliary roller 38 is resiliently compressed by about 0.15 to 0.25 mm in the contacting region. The auxiliary roller 38 is continuously rotated by a driving means that is not shown in a direction indicated by arrow 39 in FIG. 1. The stirrer means 20 includes a rotary shaft 40 rotatably mounted between the two side walls of the developing housing 12, and a stirrer member 42 fitted to the rotary shaft 40, and is continuously rotated by a driving means that is not shown in a direction indicated by arrow 44 in FIG. 1.

Figure 2:
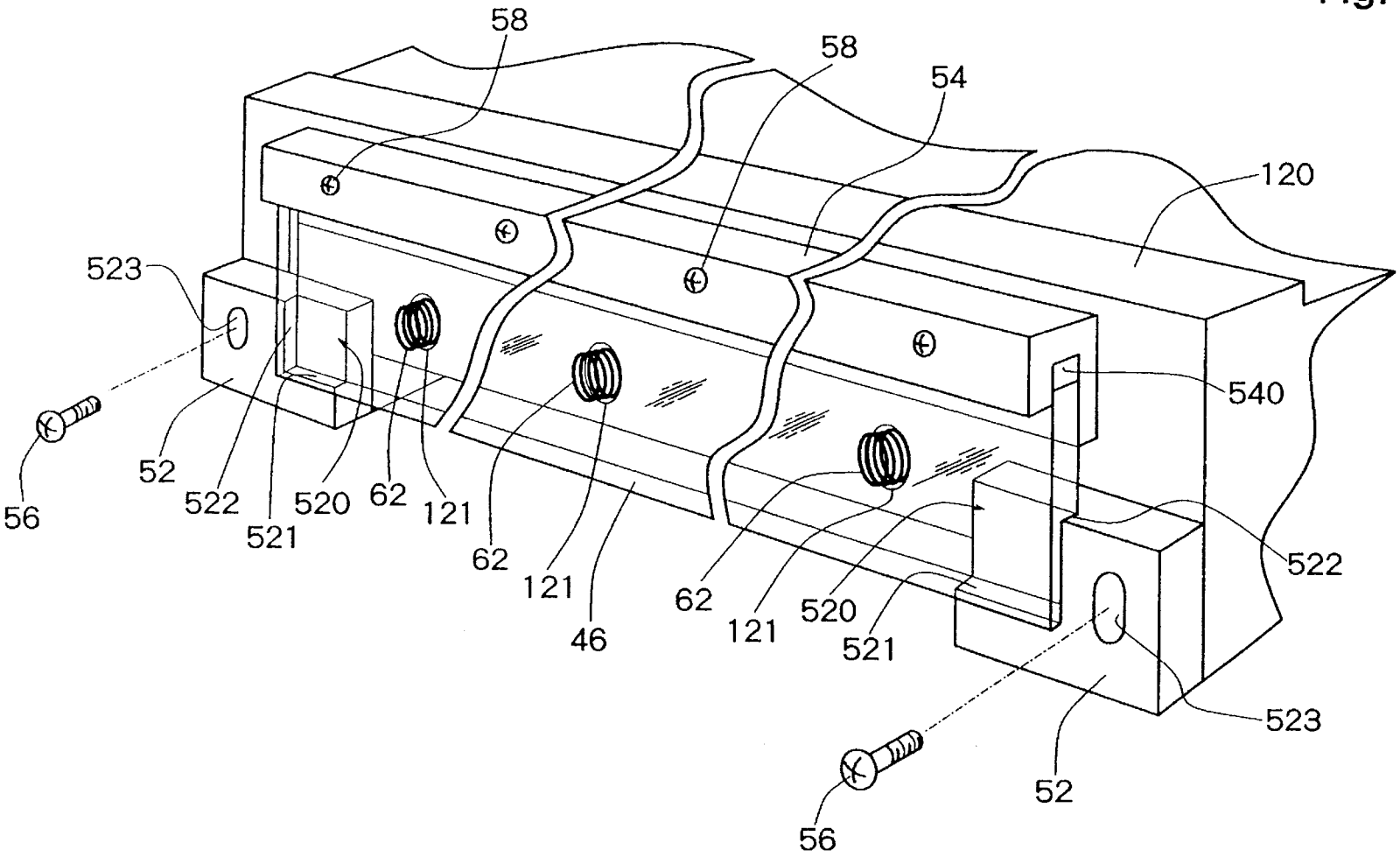
FIG. 2 is a perspective view of a limiting means constituting the apparatus for developing an electrostatic latent image that is shown in FIG. 1.

Next, the limiting means 22 will be described with reference also to FIG. 2. The limiting means 22 comprises a blade 46 made of a rigid member which is brought into forced contact with the peripheral surface of the roller 26 of the developing agent application means 16, a blade support means 48 for supporting the blade 46 in a manner that the one surface thereof can be moved in a direction to come into forced contact with the peripheral surface of the roller 26, and a resilient urging means 50 which pushes the blade 46 in a direction in which its one surface is brought into forced contact with the peripheral surface of the roller 26.

The above-mentioned rigid blade 46 is constituted by a plate-like member of which at least the one surface (which is brought into forced contact with the peripheral surface of the roller 26) is a flat surface extending in the direction of width (in a direction perpendicular to the paper in FIG. 1) along the peripheral surface of the roller 26. It is desired that at least a portion of the one surface of the blade 46 brought into forced contact with the peripheral surface of the roller 26 has a surface roughness which is sufficiently small and has a center line average roughness Ra, specified under JIS B 0601, of not larger than 6.00, particularly not larger than 0.20, and more particularly not larger than 0.02. When the roughness of the one surface of the blade 46 becomes too large, the surface of the thin developing agent layer formed on the peripheral surface of the roller 26 of developing agent application means 16 is not flattened to a sufficient degree and tends to become non-uniform. A commercially available sheet glass can be used as a rigid material since it is available at a relatively low cost for forming the blade 46, yet such sheet glass has sufficiently small surface roughness and having high hardness and abrasion resistance. The sheet glass may have a thickness of about 3 mm. When it is desired to apply a predetermined voltage to the blade 46 to control the charging property of the toner, one surface of the sheet glass may be coated with an electrically conductive film. A sheet glass placed in the market in the trade name of "Nesa Glass" can be favorably used as the sheet glass coated on one surface thereof with an electrically conductive film. The blade 46 may be constituted by using a rigid metallic member such as a stainless steel instead of the sheet glass. In order to decrease the surface roughness of the one surface of the metal plate constituting the blade 46, the one surface of the metal plate may be subjected to a proper treatment, as required. If desired, the blade 46 may be constituted by a laminate of a sheet glass and a metal plate, so that the exposed surface of the glass serves as the one surface that will be brought into forced contact with the roller 26 of the developing agent application means 16.

The blade support means 48 includes a pair of lower support members 52, 52 for supporting both lower ends of the blade 46, and an upper support member 54 for supporting the upper edge of the blade 46. The lower support members 52, 52 have cut-away portions 520, 520 for forming bottom surfaces 521, 521 and side surfaces 522, 522, and further have mounting holes 523, 523 which are elongated in the up-and-down direction. The lower support members 52, 52 are arranged at a predetermined distance in the direction of width, and are fastened to a mounting portion 120 that is formed integrally with the developing housing 12 by screws 56, 56 that pass through the mounting holes 523, 523. The lower support members 52, 52 are so secured to the mounting portion 120 that the distance between the side surfaces 522 and 522 forming the cut-away portions 520, 520 is nearly the same as the size of the blade 46 in the direction of width, and the lower end at both ends of the blade 46 is placed on the bottom surfaces 521, 521 forming the cut-away portions 520, 520. The upper support member 54 is disposed above the lower support members 52, 52 at a predetermined distance, and is secured to the mounting portion 120 of the developing housing 12 using a plurality of screws 58. The upper support member 54 has nearly the same length as the size of the blade 46 in the direction of width, and has a fitting groove 540 which is slightly wider than the thickness of the blade 46. The blade 46 is fitted at its upper edge to the fitting groove 540. As shown in FIG. 1, in the bottom surface of the fitting groove 540 are formed a plurality of recessed portions 541 being spaced apart in the lengthwise direction, and compression coil springs 60 are fitted in the recessed portions 541 to act on the upper edge surface of the blade 46 fitted into the fitting groove 540 in order to downwardly urge the blade 46.

The resilient urging means 50 has a plurality of compression coil springs 62 (three springs in the illustrated embodiment) arranged between the lower support members 52, 52 and the upper support member 54 on the side of the other surface of the blade 46 (i.e., the opposite surface of the blade 46 from the surface which contacts the roller 26). The compression coil springs 62 are disposed in through holes 121 (three holes in the illustrated embodiment) which are formed at a predetermined distance in the direction of width in the mounting portion 120 of the developing housing 12 and are opposed to the other surface of the blade 46. A closing plate 64 is attached by using screws 66 to the back surface of the mounting portion 120 to close the through holes 121 on one side thereof. By attaching the closing plate 64, the compression coil springs 62 act upon the other surface of the blade 46 so that the one surface of the blade 46 is brought into forced contact with the peripheral surface of the roller 26 that constitutes the developing agent application means 16.

The contacting force for bringing the blade 46 into contact with the peripheral surface of the roller 26 of the developing agent application means 16 can be suitably selected depending upon the thickness of the developing agent layer that is to be formed on the peripheral surface of the roller 26. The thickness of the developing agent layer formed on the peripheral surface of the roller 26 decreases with an increase in the contacting force. When the contacting force is too great, on the other hand, the roller 26 tends to be prevented from smoothly rotating. In the developing mode of the illustrated embodiment, it is generally preferable that the developing agent layer formed on the peripheral surface of the roller 26 has the thickness of 15 to 40 μm, particularly, about 20 μm to about 27 μm. To form the developing agent layer having such a thickness, the blade 46 needs be brought into forced contact with the peripheral surface of the roller 26 at a line pressure (pressure per a unit length in the direction of width) of from 10 to 90 g/cm. In the illustrated embodiment, the line pressure has been set to be from 40 to 90 g/cm.

It is desired that the lower end of the blade 46 protrudes toward the upstream side, as viewed in the direction in which the roller 26 moves, beyond the portion where the blade 46 is brought into forced contact with the roller 26. It is desired that the protruding length at the lower end of the blade 46 (i.e., length from the center of contact between the roller 26 and the blade 46 to the lower end of the blade 46) is, usually, 0.5 to 4.0 mm, particularly 0.8 to 3.5 mm, and more particularly 1.0 to 2.0 mm. When the length of protrusion is too short or is substantially zero, the limiting action by the blade 46 becomes excessive, making it difficult to favorably form the developing agent layer. When the length of protrusion is too long, on the other hand, the developing agent layer that is formed tends to become too thick and the amount of charge of the toner is liable to become too small. As described above, a highly precise positional relationship must be maintained between the lower end of the blade 46 and the roller 26. In the illustrated embodiment, the lower end of the blade 46 is placed on the bottom surfaces 521, 521 constituting the cut-away portions 520, 520 in the lower support members 52, 52, to control the amount of protrusion of the blade 46 beyond the position where it is brought into forced contact with the roller 26 that constitutes the developing agent application means 16. Therefore, the efficiency of the assembling operation is strikingly improved. In the illustrated embodiment, furthermore, the lower support members 52, 52 constituting the blade support means 48 are adjustable along the mounting holes 523, 523 which are elongated in the up-and-down direction, and enable the amount of protrusion of the blade to be adjusted.

The apparatus for developing an electrostatic latent image according to the illustrated embodiment is constituted as described above, and described below is its function. Upon the start of operation of the apparatus for developing an electrostatic latent image, the roller 26 of the developing agent application means 16, auxiliary roller 38 of the feeding means 18 and the stirrer means 20 are rotated in the directions indicated by arrows by driving means that are not shown. The roller 26 of the developing agent application means 16 rotates continuously in the direction indicated by arrow 28, the feeding means 18 acts upon the roller 26 in the developing agent holding zone 30 whereby the developing agent held on the peripheral surface of the roller 26 is peeled off and the developing agent is newly fed onto the peripheral surface of the roller 26. In the developing agent limiting zone 32, the blade 46 of the limiting means 22 acts upon the developing agent held on the peripheral surface of the roller 26, so that the amount of the developing agent held on the peripheral surface of the roller 26 is limited to the required amount to form a thin layer thereof. Upon receiving the action of the blade 46, furthermore, the toner constituting the developing agent is frictionally charged with a predetermined polarity, e.g., positive polarity. In the action for limiting the developing agent, the blade 46 is pushed by a plurality of compression coil springs 62 arranged in the direction of width and is allowed to produce a contacting force which is uniform over the whole width. Moreover, the blade 46 is supported by the lower support members 52, 52 constituting the blade support means 48 and by the upper support member 54 not in a fixed manner, and is allowed to move in a direction in which it is brought into forced contact with the peripheral surface of the roller 26 of the developing agent application means 16. Therefore, the surface precision is not affected by the surface precision of the support members. Accordingly, the support members need not be machined with a high precision beyond need. Next, in the developing region 34, the developing agent is applied to the electrostatic latent image on the electrostatic photosensitive material disposed on the peripheral surface of the rotary drum 1, and the electrostatic latent image is developed into a toner image. For instance, the electrostatic latent image has a non-image region that is electrically charged to about +700 V and an image region electrically charged to about +120 V, and the toner is adhered to the image region (so-called reversal development). The rotary drum 1 is continuously rotated in a direction indicated by arrow 3 in FIG. 1. In the developing region 34, therefore, the peripheral surface of the rotary drum 1 and the peripheral surface of the roller 26 of the developing agent application means 16 are moved in the same direction. A moving speed V2 of the peripheral surface of the roller 26 is set to be slightly greater than a moving speed V1 of the peripheral surface of the rotary drum 1, preferably in a relationship of $1.5\ V1 \leqq V2 \leqq 2.2\ V1$. In this case, the developing agent is sufficiently carried to the developing zone 34 by the roller 26, the toner that has once adhered to the non-image portion of the electrostatic latent image is properly peeled off by the scraping action of the peripheral surface of the roller 26 against the peripheral surface of the drum I and, thus, there can be obtained a good toner image having a properly developed density without fogging. Desirably, the developing agent consists of toner only having a volume average particle diameter (vol. 50%: the volume of the toner smaller than the volume average particle size is the same as the volume of the toner larger than the volume average particle diameter) of 8.0 to 12.0 μm and a volume resistivity of not smaller than $10^8$ Ω.cm.

Figure 3:
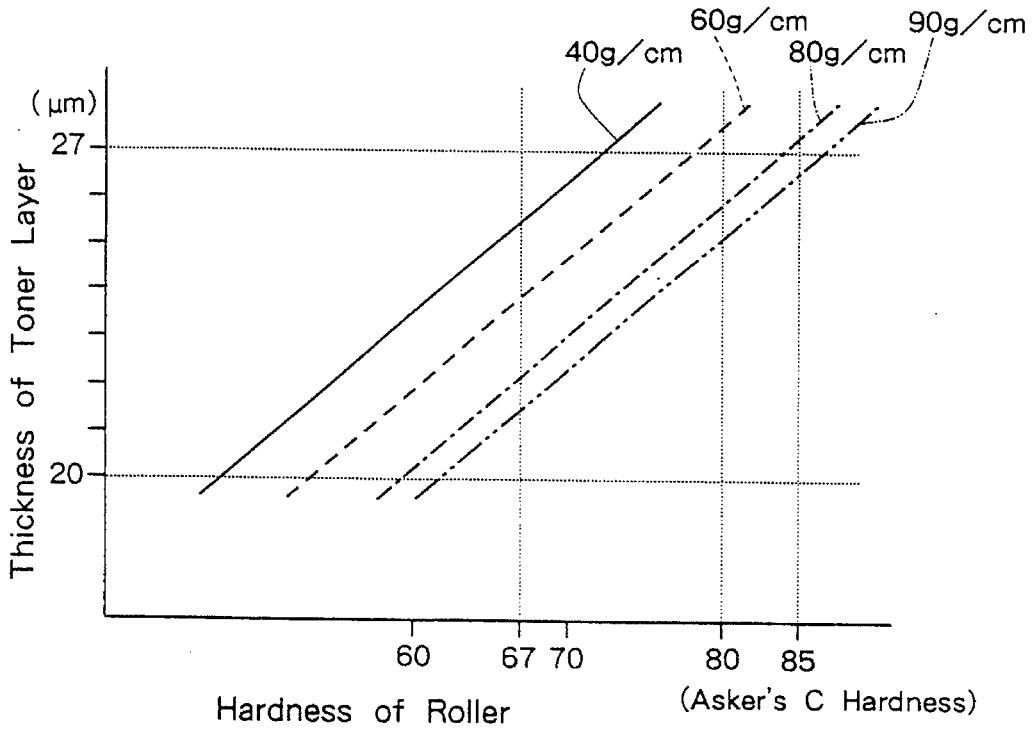
FIG. 3 is a diagram illustrating a relationship between the hardness of a roller constituting a developing agent application means and the thickness of the toner layer formed on the peripheral surface of the roller.

Described below is how to set the hardness of the roller 26 that constitutes the developing agent application means 16. FIG. 3 is a diagram of measurement results of the thickness of the toner layer formed on the peripheral surface of the roller 26 obtained by using rollers 26 of urethane rubbers of different hardnesses to constitute the developing agent application means 16 and by changing the contacting force of the blade 46 upon the peripheral surface of the roller 26. A glass blade is used as the blade 46. In FIG. 3, the solid line represents values of when the line pressure (pressure per a unit length in the direction of width) of the glass blade acting on the peripheral surface of the roller that constitutes the developing agent application means is 40 g/cm, the broken line represents values when the line pressure of the glass blade is 60 g/cm, the dot-dash chain line represents values when the line pressure of the glass blade is 80 g/cm, and the two-dot chain line represents values when the line pressure of the glass blade is 90 g/cm. As will be understood from FIG. 3, the thickness of the toner layer formed on the surface of the roller decreases with a decrease in the hardness of the roller, and increases with an increase in the hardness of the roller. Moreover, the thickness of the toner layer formed on the surface of the roller increases with a decrease in the line pressure of the glass blade acting on the peripheral surface of the roller that constitutes the developing agent application means, and decreases with an increase in the line pressure. As described earlier, when the thickness of the toner layer formed on the surface of the roller of the developing agent application means is smaller than, for example, 20 μm, the image density so decreases that a copy cannot be seen well. When the thickness of the toner layer exceeds, for example, 30 μm, on the other hand, there occurs a so-called image base fogging in which the toner adheres to portions other than the image. It is therefore desired that the hardness of the roller constituting the developing agent application means is set by taking variance in the setting conditions (length of protrusion, contacting force) of the blade into consideration and that the toner layer formed on the surface of the roller has a thickness of from 20 to 27 μm. Described below with reference to FIG. 3 is the upper limit of the hardness of the roller that constitutes the developing agent application means. When the line pressure of the blade is 90 g/cm and the roller has an Asker's C hardness of 85, there is obtained a toner layer having a thickness of 27 μm which is the upper limit. Therefore, when the roller has an Asker's C hardness which is greater than 85, the thickness of the toner layer cannot be suppressed to be not larger than 27 μm unless the line pressure of the blade is selected to be greater than 90 g/cm. As the contacting force of the blade so increases that the line pressure of the blade exceeds 100 g/cm, it was learned that the toner layer formed on the surface of the roller loses stability in regard to its thickness. When the line pressure of the blade is increased, an increased load is exerted on the roller and the driving force must be increased. To increase the driving force of the roller, the ability of an electric motor which is a driving source must be increased, resulting in the necessity for increasing the strength of the power transmission mechanism as well as in the necessity for reinforcing the mechanism for supporting the roller. In the image-forming machine equipped with the developing apparatus of this kind, therefore, the upper limit in the line pressure of the blade is substantially about 90 g/cm when the quality of image, strength of the constituent members and manufacturing cost are considered. From the above-mentioned points of view, it is desired that the upper limit of the roller hardness is set to be about 85 in terms of Asker's C hardness which makes it possible to obtain a toner layer having a thickness of an upper limit of 27 μm in the case when the line pressure of the blade is 90 g/cm. When the roller constituting the developing agent application means is made of a synthetic rubber, on the other hand, the synthetic rubber must have an Asker's C hardness of not smaller than 65. Otherwise, the production yield becomes poor and it becomes difficult to stably maintain the quality. When variance in the production is taken into consideration, it is desired that the lower limit of the roller hardness is set to be about 67 in terms of Asker's C hardness.

In the apparatus for developing an electrostatic latent image of the present invention as described above, the limiting means for limiting the amount of the developing agent held on the surface of the developing agent application means is constituted by the blade made of a rigid member that will be brought into forced contact with the surface of the developing agent application means, by the blade support means for supporting the blade in a manner that its one surface is allowed to move in a direction in which it is brought into forced contact with the surface of the developing agent application means, and by the resilient urging means which is disposed on the side of the other surface of the blade and pushes the blade in a direction in which its one surface is brought into forced contact with the surface of the developing agent application means. Accordingly, the blade is supported by the blade supporting means not in a fixed manner but in a manner that it is allowed to move in a direction in which it is brought into forced contact with the peripheral surface of the developing agent application means. Therefore, the surface precision is not affected by the surface precision of the support member and, hence, the support member needs not be machined with a high precision beyond need. It is therefore allowed to obtain an apparatus for developing an electrostatic latent image, which is equipped with a relatively cheaply constructed support means. Moreover, since the blade is constituted by a rigid member, the amount of its displacement in the direction of width is very small during the operation when the amount of the developing agent is being limited. This makes it possible to form a toner layer which is uniform over the whole width and to stably obtain an image.

According to the present invention, furthermore, the rigid blade is constituted by a sheet glass. Therefore, the blade having a sufficiently small surface roughness, a large hardness and abrasion resistance can be produced at relatively low cost, and a stable image can be obtained over extended periods of time.

According to the present invention, the blade support means is constituted by the lower support members on which the lower end of the blade is placed and supported, the upper support member for supporting the upper edge of the blade, and a resilient urging means which is disposed between the upper support member and the upper edge of the blade. With the lower end of the blade being placed on the lower support members, therefore, the amount of protrusion of the blade beyond the position where it is brought into forced contact with the developing agent application means is controlled, and the assembling operation is strikingly improved.

In the present invention, the resilient urging means which is disposed on the side of the other surface of the blade and pushes the blade in a direction in which its one surface comes into forced contact with the surface of the developing agent application means has a plurality of spring members disposed at a distance along in the direction of the width of the blade. Accordingly, the blade is brought into forced contact with the developing agent application means with a uniform force over the whole width, making it possible to uniformly form a toner layer and to stably obtain an image.

As another invention, there is provided an apparatus for developing an electrostatic latent image in which the limiting means is made of a rigid member which will be brought into forced contact with the surface of the developing agent application means, and the developing agent application means is constituted by a solid synthetic rubber roller having an Asker's C hardness of 67 to 85, to form a toner layer having such a thickness that makes it possible to obtain a desired image density and to maintain stable quality with good yields.

What we claim is:

1. An apparatus for developing an electrostatic latent image comprising: a developing housing, a developing agent application means which is disposed in said developing housing, holds the developing agent on a surface thereof in a developing agent-holding zone, and conveys the thus held developing agent into a developing zone to apply it onto the electrostatic latent image, and a limiting means for limiting an amount of the developing agent held on the surface of the developing agent application means in a developing agent limiting zone located between the developing agent-holding zone and the developing zone, wherein said limiting means includes a blade made of a rigid member that is brought into forced contact with the surface of said developing agent application means, a blade support means for supporting said blade in a manner such that a first surface thereof is moved in a direction in which it comes into forced contact with the surface of said developing agent application means, and a first resilient urging means which is disposed on a side of a second surface of said blade to push said blade in a manner such that the first surface thereof is brought into forced contact with the surface of said developing agent application means, wherein said blade support means includes lower support members for supporting a lower end of the blade, an upper support member for supporting an upper edge of the blade, and a second resilient urging means which is disposed between said upper support member and the upper edge of said blade and downwardly pushes said blade.

2. An apparatus for developing an electrostatic latent image according to claim 1, wherein said blade is constituted by a sheet glass.

3. An apparatus for developing an electrostatic latent image according to claim 1, wherein said lower support members are allowed to move in an up-and-down direction.

4. An apparatus for developing an electrostatic latent image according to claim 1, wherein said lower support members are constituted by a pair of support members for supporting the lower end of said blade at both sides thereof.

5. An apparatus for developing an electrostatic latent image according to claim 1, wherein said first resilient urging means is equipped with a plurality of spring members that are arranged along a width direction of the blade.

6. An apparatus for developing an electrostatic latent image comprising: a developing housing, a developing agent application means which is disposed in said developing housing, holds the developing agent on a surface thereof in a developing agent-holding zone, and conveys the thus held developing agent into a developing zone to apply it onto the electrostatic latent image, and a limiting means for limiting an amount of the developing agent held on the surface of said developing agent application means in a developing agent limiting zone located between the developing agent-holding zone and the developing zone, wherein said limiting means is made of a rigid member that is brought into forced contact with the surface of said developing agent application means such that a line pressure between the developing agent application means and the limiting means is in the range of 40 to 90 g/cm, and a thickness of a layer of the developing agent formed on the surface of the developing agent application means is in the range of 20 to 27 μm, and wherein said developing agent application means is constituted by a solid synthetic rubber roller having an Asker's C hardness of 67 to 85.

7. An apparatus for developing an electrostatic latent image according to claim 1, wherein a line pressure in the range of 40 to 90 g/cm is produced between the developing agent application means and the limiting means.

8. An apparatus for developing an electrostatic latent image according to claim 1, wherein a thickness of a layer of the developing agent formed on the surface of the developing agent application means is in the range of 20 to 27 μm.

9. An apparatus for developing an electrostatic latent image according to claim 1, wherein the developing agent application means is constituted by a solid synthetic rubber roller having an Asker's C hardness of 67 to 85.

10. An apparatus for developing an electrostatic latent image comprising:

a developing housing, a developing agent application means which is disposed in the developing housing, holds the developing agent on a surface thereof in a developing agent-holding zone, and conveys the thus held developing agent into a developing zone to apply it onto the electrostatic latent image, and a limiting means for limiting an amount of the developing agent held on the surface of the developing agent application means in a developing agent limiting zone located between the developing agent-holding zone and the developing zone, wherein the limiting means includes a blade made of a rigid member that is brought into forced contact with the surface of the developing agent application means, a blade support means for supporting the blade in a manner such that a first surface thereof is moved in a direction in which it comes into forced contact with the surface of the developing agent application means, and a first resilient urging means which is disposed on a side of a second surface of the blade to push the blade in a manner such that the first surface thereof is brought into forced contact with the surface of the developing agent application means, wherein the blade support means includes lower support members for supporting a lower end of the blade, and wherein the lower support members are allowed to move in an up-and-down direction.

11. An apparatus for developing an electrostatic latent image according to claim 10, wherein the blade is constituted by a sheet glass.

12. An apparatus for developing an electrostatic latent image according to claim 10, wherein the blade support means further includes an upper support member for supporting an upper edge of the blade, and a second resilient urging means which is disposed between the upper support member and the upper edge of the blade and downwardly pushes the blade.

13. An apparatus for developing an electrostatic latent image according to claim 10, wherein the lower support members are constituted by a pair of support members for supporting the lower end of the blade at both sides thereof.

14. An apparatus for developing an electrostatic latent image according to claim 10, wherein the first resilient urging means includes a plurality of spring members that are arranged along a width direction of the blade.

15. An apparatus for developing an electrostatic latent image according to claim 10, wherein a line pressure in the range of 40 to 90 g/cm is produced between the developing agent application means and the limiting means.

16. An apparatus for developing an electrostatic latent image according to claim 10, wherein a thickness of a layer of the developing agent formed on the surface of the developing agent application means is in the range of 20 to 27 μm.

17. An apparatus for developing an electrostatic latent image according to claim 10, wherein the developing agent application means is constituted by a solid synthetic rubber roller having an Asker's C hardness of 67 to 85.

18. An apparatus for developing an electrostatic latent image comprising:

a developing housing, a developing agent application means which is disposed in the developing housing, holds the developing agent on a surface thereof in a developing agent-holding zone, and conveys the thus held developing agent into a developing zone to apply it onto the electrostatic latent image, and a limiting means for limiting an amount of the developing agent held on the surface of the developing agent application means in a developing agent limiting zone located between the developing agent-holding zone and the developing zone, wherein the limiting means includes a blade made of a rigid member that is brought into forced contact with the surface of the developing agent application means, a blade support means for supporting the blade in a manner such that a first surface thereof is moved in a direction in which it comes into forced contact with the surface of the developing agent application means, and a first resilient urging means which is disposed on a side of a second surface of the blade to push the blade in a manner such that the first surface thereof is brought into forced contact with the surface of the developing agent application means, wherein the blade support means includes lower support members for supporting a lower end of the blade, and wherein the lower support members are constituted by a pair of support members for supporting the lower end of the blade at both sides thereof.

19. An apparatus for developing an electrostatic latent image according to claim 18, wherein the blade is constituted by a sheet glass.

20. An apparatus for developing an electrostatic latent image according to claim 18, wherein the blade support means further includes an upper support member for supporting an upper edge of the blade, and a second resilient urging means which is disposed between the upper support member and the upper edge of the blade and downwardly pushes the blade.

21. An apparatus for developing an electrostatic latent image according to claim 18, wherein the lower support members are allowed to move in an up-and-down direction.

22. An apparatus for developing an electrostatic latent image according to claim 18, wherein the first resilient urging means includes a plurality of spring members that are arranged along a width direction of the blade.

23. An apparatus for developing an electrostatic latent image according to claim 18, wherein a line pressure in the range of 40 to 90 g/cm is produced between the developing agent application means and the limiting means.

24. An apparatus for developing an electrostatic latent image according to claim 18, wherein a thickness of a layer of the developing agent formed on the surface of the developing agent application means is in the range of 20 to 27 μm.

25. An apparatus for developing an electrostatic latent image according to claim 18, wherein the developing agent application means is constituted by a solid synthetic rubber roller having an Asker's C hardness of 67 to 85.

* * * * *